United States Patent [19]

Waki et al.

[11] Patent Number: 4,626,494

[45] Date of Patent: Dec. 2, 1986

[54] HARDENED COLOR DIFFUSION TRANSFER PHOTOGRAPHIC MATERIALS

[75] Inventors: Kokichi Waki; Yukio Karino, both of Kanagawa, Japan

[73] Assignee: Fuji Photo Film Co., Ltd., Kanagawa, Japan

[21] Appl. No.: 765,787

[22] Filed: Aug. 15, 1985

[30] Foreign Application Priority Data

Aug. 15, 1984 [JP] Japan ..... 59-170134

[51] Int. Cl.[4] ..... G03C 1/40; G03C 5/54

[52] U.S. Cl. ..... 430/213; 430/212; 430/217

[58] Field of Search ..... 430/207, 212, 213, 215, 430/217

[56] References Cited

U.S. PATENT DOCUMENTS 3,427,158 2/1969 Carlson et al. ..... 430/212

3,578,540 5/1971 Land ..... 430/15

FOREIGN PATENT DOCUMENTS 1533924 11/1978 United Kingdom ..... 430/212

*Primary Examiner*—Richard L. Schilling

*Attorney, Agent, or Firm*—Sughrue, Mion, Zinn, Macpeak and Seas

[57] ABSTRACT

A novel color diffusion transfer photographic material comprising (A) a light-sensitive element comprising a first support having thereon at least a silver halide photographic emulsion layer and a dye providing compound, (B) an image receiving element comprising a second support having thereon at least an image receiving layer and (C) means for providing an alkaline treating solution between element (A) and (B), wherein (i) the swollen film thickness of said light-sensitive element (A) is from about 10 μm after being contacted with water at 25° C. for 5 minutes;

(ii) the swollen film thickness of said image receiving element (B) is from about 10 μm to 40 μm after being contacted with 0.1N KOH aqueous solution at 25°C for 3 minutes; and (iii) said means for providing an alkaline treating solution provides an average thickness of said treating solution between element (A) and (B) during development of from about 40 μm to 80 μm.

The present photographic materials provide a sharp image having sufficient density with reduced density mottle and air bubbles.

16 Claims, No Drawings

HARDENED COLOR DIFFUSION TRANSFER PHOTOGRAPHIC MATERIALS

FIELD OF THE INVENTION

The present invention relates to instant photography, and in particular, to color diffusion transfer photographic materials having improved photographic and practical characteristics.

BACKGROUND OF THE INVENTION

In diffusion transfer photography using a "peel apart" photographic material, a light-sensitive element typically is exposed, superposed with an image-receiving element and developed to transfer a silver or dye image from the light-sensitive element to the image-receiving element, after which the two elements are peeled apart to produce a photographic containing the transferred image, for example, as disclosed in U.S. Pat. No. 2,983,606 and K. I. Jacobson and R. E. Jacobson, *Imaging Systems,* pages 91–102, The Focal Press, London (1976). The quality of the image formed on the image receiving element, largely depends upon the hygroscopicity of the light-sensitive element and the image receiving element, and the degree of swelling of each element must be controlled during development to provide sufficient image density and to avoid density mottle in the formed image. In addition, if the layer of developing solution inserted between the superposed elements is too thick, a sufficiently sharp image cannot be formed, and if the layer is too thin, sufficient image density cannot be attained and some density mottle occurs, and further, white spots often appear in the image due to air-bubbles present on the image forming surface.

British Pat. No. 1,533,924 discloses a peelapart material containing a hygroscopic layer, whereby the distance between the light-sensitive element and the image receiving element may be reduced, after the hygroscopic layer is swollen, and thus, the sharpness of the formed image may be increased. Such conventional materials have the disadvantage, however, that sufficient image density cannot be attained, and some density mottle occurs.

SUMMARY OF THE INVENTION

An object of the present invention is to provide a novel color diffusion transfer photographic material capable of forming a sharp image having a sufficient density with reduced density mottle and air bubbles.

This and other objects of the present invention are attained by a novel color diffusion transfer photographic material comprising (A) a light-sensitive element comprising a first support having thereon at least a silver halide photographic emulsion layer and a dye providing substance, (B) an image receiving element comprising a second support having thereon at least an image receiving layer and (C) means for providing an alkaline treating solution between elements (A) and (B), wherein (i) the swollen film thickness of the light-sensitive element (A) is from about 10 μm to 45 μm after being contacted with water at 25° C. for 5 minutes;

(ii) the swollen film thickness of the image receiving element (B) is from about 10 μm to 40 μm after being contacted with a 0.1N KOH aqueous solution at 25° C. for 3 minutes; and (iii) the means for providing an alkaline treating solution provides an average thickness of the treating solution between elements (A) and (B) during development is of from about 40 μm to 80 μm.

DETAILED DESCRIPTION OF THE INVENTION

As used herein the term "swollen film thickness" means the difference between the dry thickness of a layer and its thickness after wetting, i.e., the wet and swollen film thickness of an element minus the dry thickness thereof.

Measurement of swollen film thickness herein was carried out using a film thickness gauge made by Anritsu Electric Co., Ltd., and the measuring terminal of the gauge, which is in contact with a sample to be measured, was modified to be a spherical terminal made of a stainless steel. For the measurements herein about 0.5 ml of $H_2O$ or 0.1NKOH aqueous solution was dropped on about 25 $mm^2$ of the surface of a sample and then the measuring terminal was brought into contact with the surface of the sample at intervals of 3 seconds to automatically record the measured values on a recording paper. Afterwards, the swollen film thickness of each sample for the appropriate time interval was calculated from the measured and recorded values.

In the photographic materials of the present invention, the swollen film thickness of the light-sensitive element is regulated to fall within the range of about 10 μm to 45 μm to 45 μm, that of the image receiving element is regulated to fall within the range of about 10 μm to 40 μm, and the thickness of the treating solution during development is regulated to fall within the range of about 40 μm to 80 μm. In this manner the treating solution is regularly distributed to both the light-sensitive element and the image receiving element, and a sharp image having sufficient image density is obtained, which is free from any disadvantageous density mottle or white spots, i.e., without air-bubbles. These are the characteristics effects and merits of the present invention.

In order to regulate the swollen film thickness of the light-sensitive element and the image receiving element of the present invention, a conventional hardening agent may be used in each. Examples of such hardening agents include the following, although the present invention is not to be construed as being limited thereto.

Chromium salts: $KCr(SO_4)_2.12H_2O$; $Cr(CH_3CO_2)_2$; (1)

Aldehydes: HCHO; OHC—CHO; OHC—$(CH_2)_3$—CHO; (2)

N—methylol compounds: (3)

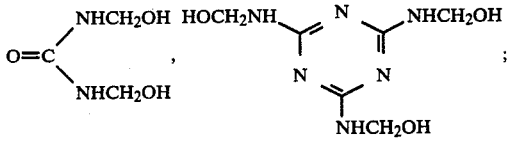

(4)

Diketones: $CH_3$—C(=O)—C(=O)—$CH_3$, 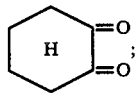 ;

Mucohalogenic acids: OHC—C(Cl)=C(Cl)—COOH; (5)

-continued

Active halogeno-compounds: (6)

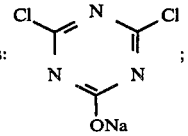

Active vinyl compounds: (7)

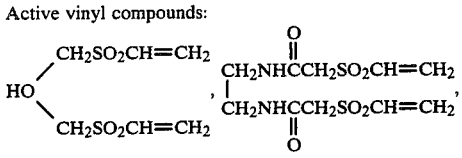

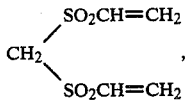

Dioxane derivatives: (8)

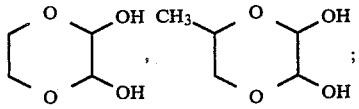

Epoxy compounds: (9)

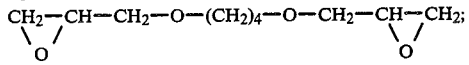

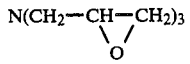

Phenols: (10)

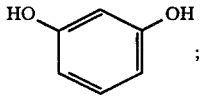

Carbodiimide compounds: (11)

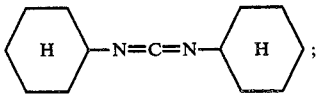

The hardening agent may be added in any layer of the photographic elements.

The amount of the hardening agent to be added is appropriately regulated in accordance with the degree of the improvement on the photographic elements, and is suitably from about 0.03 mmol/m$^2$ to 3 mmol/m$^2$, and preferably from about 0.1 mmol/m$^2$ to 1 mmol/m$^2$.

The swollen film thickness of the light-sensitive element of the present invention is suitably from about 10 μm to 45 μm, and preferably from about 15 μm to 35 μm.

The swollen film thickness of the image receiving element of the present invention is suitably from about 10 μm to 40 μm, preferably from about 15 μm to 30 μm. The thickness of the treating solution can be decided by a spacer prepared in railwise on both ends of the side that the treating solution is spread. Examples of the spacer include paper, cellulose acetate film, polystyrene film, polyethylene terephthalate film and polycarbonate film. In these spacers, the spacer that a variation of the thickness of the treating solution is within 20% is preferably used. The treating solution is filled in a container capable of rupturing and is spread by press-roll member such as a roller between the light-sensitive element and the image receiving element to form a liquid layer.

The thickness of the treating solution of the present invention during development is suitably from about 40 μm to 80 μm, preferably from about 50 μm to 70 μm.

The support for the light-sensitive element or image receiving element to be used in the present invention may either be transparent or non-transparent, and can be made of any conventional material that is free from serious dimensional change during treatment. Conventional photographic supports which are generally used in photographic materials may be used in the present invention, and examples of such supports include cellulose acetate film, polystyrene film, polyethylene terephthalate film, polycarbonate film, baryta paper and resin-coated paper such as a water-proof polyethylene laminated paper. In the above examples, polyethylene terephthalate film is preferably used for the light-sensitive element and polyethylene terephthalate film and resin-coated paper such as a water-proof polyethylene laminated paper is preferably used for the image receiving element.

In order to otain a white background, a whitening agent such as titanium oxide or barium sulfate may be added to either support of the present invention, or alternatively, such whitening agent may be coated on the surface of either support.

Either support of the photographic material of the present invention, may be rendered opaque to permit the material to be developed under lighted conditions, e.g. by laminating a polyethylene coat containing a light-shielding agent such as carbon black on the support, or by coating a dispersion of a water soluble polymer (such as gelatin or polyvinyl alcohol) and a light-shielding agent (such as carbon black) on the support. The amount of the light-shielding agent used may appropriately be regulated in accordance with the sensitivity of the photographic material to be shielded from light. That is, the amount is regulated to the extent that fog is not occured in the light-sensitive materials even if the light-shielding agent is leaving for five minutes at 200,000 lux of light source having color temperature of 4,800 K. to 6,500 K. and is preferably from about 5–10 (optical density).

As a binder or a protective colloid which may be used in the present invention, gelatin is preferred, and other hydrophilic colloids may also be used.

Suitable binders or protective colloids for use in the present invention include gelatin derivatives, graft-polymers of gelatin with other high molecular compounds, proteins such as albumin or casein; cellulose derivatives such as hydroxyethyl cellulose, carboxymethyl cellulose or cellulose sulfate; saccaride derivatives such as sodium alginate or starch derivatives; and other synthetic hydrophilic high molecular mono- or co-polymers such as polyvinyl alcohol, partially acetallized-polyvinyl alcohol, poly-N-vinyl-pyrrolidone, polyacrylic acid, polymethacrylic acid, polyacrylamide, polyvinylimidazole, and polyvinylpyrazole.

The gelatins include lime-treated gelatin and acid-treated gelatin, as well as enzyme-treated gelatin as described in *Bull.Soc. Sci. Phot. Japan*, No. 16, page 30 (1966). In addition, hydrolyzed products or enzyme-decomposed products of gelatin may also be used.

Gelatin derivatives which may be used in the present invention include those obtained by reacting a gelatin and a compound selected from acid halides, acid anhydrides, isocyanates, bromoaceticacid, alkanesultones, vinylsulfonamides, maleinimide compounds, polyalkyleneoxides and epoxy compounds. Examples of such gelatin derivatives are described in U.S. Pat. Nos. 2,614,928, 3,132,945, 3,186,846 and 1,005,784, and Japanese Patent Publication No. 26845/67.

Gelatin-graft-polymers which may be used in the present invention include those obtained by grafting gelatin with a homo- or copolymer of a vinyl-type monomer such as acrylic acid or methacrylic acid or an ester or amide derivative thereof or acrylonitrile or styrene. In particular, preferred graft-polymers are obtained by grafting gelatin with a polymer which is compatible with gelatin such as a polymer of acrylic acid, methacrylic acid, acrylamide, methacrylamide or hydroxyalkyl methacrylate. Examples of these graft-polymers are described in U.S. Pat. Nos. 2,763,625, 2,831,767 and 2,965,884.

Silver halide emulsions which may be used in the present invention are in the form of a hydrophilic colloidal dispersion of light-sensitive silver chloride, silver bromide, silver chlorobromide, silver iodobromide, silver chloroiodobromide or a mixture thereof, and the halogen composition is selected in accordance with the use and the object of the photographic materials and with the processing method used treating condition. In general, silver bromide, silver iodobromide or silver chloroiodobromide having an iodide content of about 0 to 10 mole% and a chloride content of about 0 to 30 mole% is especially preferred for use in the present invention.

Silver halide grains that can be used in the present invention include spherical regular grains in the form of cubic, octahedral or tetradecahedral crystal form, and may further include tabular particles having an aspect ratio of about 5 or more as described in *Research Disclosure,* No. 22534 (Jan. 1983) and Japanese patent Application (OPI) No. 108528/83 (the term "OPI", as used herein, refers to a "published unexamined Japanese Patent Publication.")

In the present invention, either a surface latent image-type silver halide emulsion or an internal latent image-type silver halide emulsion may be used, and an internal latent image-type emulsion is preferred.

The internal latent image-type silver halide emulsion includes an emulsion "doped" with a metal such as copper, cadmium, led or sinc, i.e., having such hetetoelements incorporated in the silver halide crystal structure, or an emulsion with improved photographic characteristic such as re-reversal due to such doping treatment, for example, emulsions as described in U.S. Pat. No. 4,395,478.

The internal latent image-type silver halide emulsion is distinctively characterized in that the maximum density attained by internal development with an internal developer is large than the maximum density attained by surface development with a surface developer as described in T. H. James, *The Theory of the Photographic Process,* Fourth Edition, pages 171 to 176, Macmillan Publishing Co., Inc., New York (1977).

In particular, the internal latent image-type silver halide emulsion which is preferably used in the photographic materials of the present invention is characterized by a maximum density (measured by means of a conventional photographic density measuring method) obtained using an internl developer greater by a factor of at least about 5 times than the maximum density obtained analogously using a surface developer, when the emulsion is coated on a transparent support and is exposed for about 0.01–1 second (10 CMS) and thereafter developed in Developer-A described below (internal developer) for 3 minutes at 20° C., or after identical exposure is developed with Developer-B described below (surface developer) for 4 minutes at 20° C. It is particularly preferred that the maximum density obtained with the Developer-A exceeds that obtained with the Developer-B by about 10 times or more.

Developer-A

Hydroquinone: 15 g
Monomethyl-p-aminophenol-sesqui-sulfate: 15 g
Sodium sulfite: 50 g
Potassium bromide: 10 g
Sodium hydroxide: 25 g
Sodium thiosulfate: 20 g
Water to make: 1 liter Developer-B p-Oxyphenylglycine: 10 g
Sodium carbonate: 100 g
Water to make: 1 liter The internal latent image-type silver halide emulsions which may be used in the present invention include, for example, a conversion emulsion obtained by conversion of highly soluble silver halide grains such as silver chloride grains in to scarcely soluble silver halide grains such as silver bromide (iodide) grains (catastrophical precipitation method) (described in U.S. Pat. No. 2,592,250); a core/shell emulsion obtained by a method for coating a silver halide shell on a core grain wherein a chemically sensitized core emulsion comprising large grains is admixed with a silver halide emulsion comprising fine grains and the mixture is subjected to physical ripening (described in U.S. Pat. No. 3,206,313); a core/-shell emulsion obtained by a method for coating a silver halide shell on a core particle wherein a soluble silver salt solution and a soluble halide solution are simultaneously added to a chemically-sensitized core emulsion of a monodispersion while the silver ion concentration is kept at a determined value (described in British Pat. No. 1,027,146 and U.S. Pat. No. 3,761,276); a halogen-localized emulsion in which the emulsion grains comprise two or more laminated structures and the halogen composition in the first layer differs from that in the second layer (described in U.S. Pat. No. 3,935,014); and a heterometal incorporated emulsion formed by a method wherein silver halide grains are formed in an acidic medium containing a tri-valent metal ion (described in U.S. Pat. No. 3,447,927). In addition, other internal latent image-type silver halide emulsions may be used in the present invention, such as those obtained by various methods described in E. T. Wall, *Photographic Emulsion,* pp. 35–36, 52–53 (American Photographic Publishing, New York, 1929); U.S. Pat. Nos. 2,497,875, 2,563,785 and 3,511,662; and West German Patent Application (OLS) No. 2,728,108. Among the above mentioned internal latent image-type silver halide emulsions, core/shell-type emulsions are especially preferred in the present invention.

In general, for the purpose of directly forming a positive image with the above-described internal latent image-type silver halide emulsion, a method by occurence of fog by light and a method using a nucleating agent are used. In the present invention, the method using a nucleating agent is preferably used. The nucleating agent may be added to an developing solution or an light-sensitive element and in case of adding to the light-sensitive element, the nucleating agent may be added to any layer of the light-sensitive element, and preferably is added to an emulsion layer.

A nucleating agent optinally can be used in the present invention, for the purpose of directly forming a positive image with the above-described internal latent image-type silver halide emulsion. Examples of such agents include hydrazines described in U.S. Pat. Nos. 2,563,785 and 2,588,982; hydrazides and hydrazones described in U.S. Pat. No. 3,227,552; heterocyclic quaternary chlorides as described in British Pat. No. 1,283,835, Japanese Pat. (OPI) No. 69613/77 and U.S. Pat. No. 3,615,615, 3,719,494, 3,734,738, 4,094,683 and 4,115,122; sensitizing dyes having a nucleating substituent in the dye molecule, described in U.S. Pat. No. 3,718,470; thiourea-bound acylhydrazine compounds as described in U.S. Pat. Nos. 4,030,925, 4,031,127, 4,245,037, 4,255,511, 4,266,013 and 4,276,364 and British Pat. No. 2,012,443; and acylhydrazine-type compounds having a thioamide group, or a heterocyclic adsorbing group such as a triazole or tetrazole ring, described in U.S. Pat. Nos, 4,080,270 and 4,278,748 British Pat. No. 2,011,391B. However, these are not limitative and other conventional nucleating agents can be used in the present invention.

The amount of the nucleating agent to be used in the present invention is generally an amount sufficient to form an image of a sufficient maximum density when the internal latent image-type silver halide emulsion is developed with a surface developer. In practice, the amount largely depends upon the characteristics of the silver handle emulsion used (e.g., its grain size or the chemical sensitization used), the chemical structure of the nucleating agent used and the method of development. For this reason the suitable amount of nucleating agent used may widely vary. In general, when the nucleating agent is added to a developing solution, the amount used is from about 1 mg to 5 g (preferably about 5 mg to 0.5 g) per 1 liter of the developing solution. When the nucleating agent is added to an emulsion layer, the amount used is advantageously from about 0.01 mg to 5 mg (preferably about 0.05 mg to 0.5 g) per 1 mole of silver in the internal latent image-type silver halide emulsion. If the nucleating agent is added to a hydrophilic colloidal layer which is adjacent to the emulsion layer, the amount used is from about 0.01 mg to 5 mg (preferably about 0.05 mg to 0.5 g) per 1 mole of silver contained in the emulsion layer having the same area as the adjacent colloidal layer.

The photographic emulsion of the present invention may contain a sensitizing dye for the purpose of spectral sensitization the silver handle emulsion to blue light, green light, red light or infrared light having a relatively longer wavelength. Examples of sensitizing dyes which may be used therefor are cyanine dyes, merocyanine dyes, complex cyanine dyes, complex merocyanine dyes, holopolar cyanine dyes, styryl dyes, hemicyanine dyes, oxonole dyes and hemioxonole dyes.

Dye providing compound may be used in the present invention, including any conventional compounds capable of imagewise forming a diffusible dye or a precursor thereof as a result of development. For example, nondiffusible couplers capable of releasing dye developer or a diffusible dye may be used, and in particular, dye-releasing redox compounds (which are known as DRR compounds) are preferred. The mechanism of releasing dye in dye releasing redox compounds is described in T. H. James, *The Theary of the Photographic Process,* Fourth Edition, pages 366 to 372, Macmillan Publishing Co., Inc., New York, 1977.

DRR compounds are nondiffusible under alkaline conditions and are represented by the following general formula (I):

(Ballast)-(Link)-Dye (I)

wherein (Ballast) represents a ballast group capable of rendering the compound nondiffusible under alkaline conditions; (Dye) represents a dye residue or a precursor residue thereof capable of diffusing in the photographic layer at least under alkaline conditions; and (Link) represents a negative group capable of being cleaved by oxidation in development or otherwise a positive redox-cleavage group which is not cleaved by oxidation in development. When the internal latent image-type silver halide emulsion is used, (Dye) diffuses and is mordanted in the image receiving layer. As a result, the obtained photographic image is a positive photographic image when (Link) represents a negative group, or is a negative photographic image when (Link) represents a positive group.

Examples of the negative (Link) group are described in U.S. Pat. Nos. 4,135,929, 4,053,312 and 4,336,332 and Japanese Patent Application (OPI) Nos. 33826/73, 104343/76, 46730/78, 130122/79, 113624/76, 12642/81, 161131/81, 4043/82, 650/82, 20735/82, 54021/79 and 71072/81. Representative examples of such groups are N-substituted sulfamoyl groups (preferably substituted by an aryl group) as mentioned below, which, however, are not to be construed as limiting the present invention in any way.

Examples of diffusible dye-releasing (Ballst)-(Link)-are listed below.

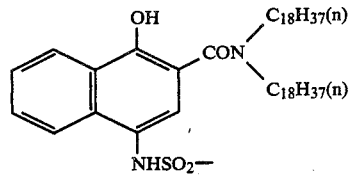

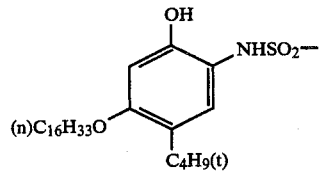

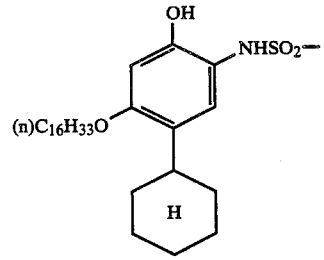

-continued

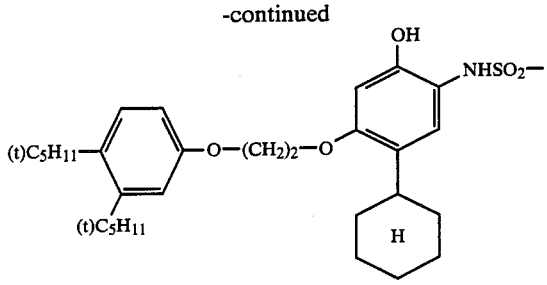

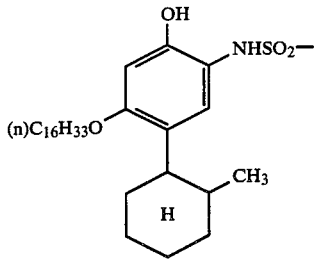

Examples of positive-type (Link) groups are described, for example, in U.S. Pat. Nos. 4,199,354, 4,199,355, 4,139,379, 4,139,389, 3,719,489 and 4,098,783, Japanese Patent Application (OPI) Nos. 111628/74, 63618/76, 69033/78, 130927/79, 164342/81 and 4819/77 and 185333/84. Especially preferred positive-type (Link) groups are given below, the present invention is not to be construed as being limited thereto.

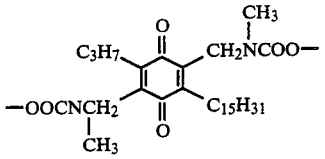

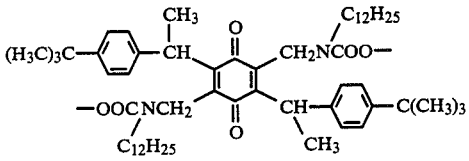

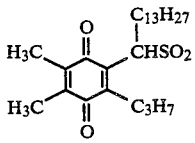

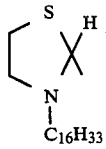

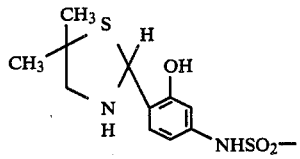

Among these positive-type dye providing compounds, those capable of releasing a dye due to reduction (such as quinone-structured compounds) can be used in combination with a nondiffusible electron donating compound (i.e., "ED compound") or a precursor thereof. Examples of such ED compounds are described in U.S. Pat. Nos. 4,263,393 and 4,278,750 and Japanese Patent Application (OPI) No. 138736/81.

Positive type DRR compounds may have an electron-donating moiety incorporated in the interior of the molecule, capable of releasing a dye by an intra-molecular redox reaction as described in Belgian Patent 834,143.

Dyes released from the DRR compounds may be either existing dyes or dye precursors capable of being converted into dyes during photographic processing or an other additional treatment process as described in U.S. Pat. No. 3,734,726 and the final image dyes may either be metal-chelated or non-metal chelated. Typical dyes include azo dyes, azomethine dyes, anthraquinone dyes, and phthalocyanine dyes, which may be either metal-chelated or non-metal chelated. In particular, azo-type cyan, magenta and yellow dyes are especially preferred for use in the present invention.

Examples of yellow dyes include those described in U.S. Pat. Nos. 3,597,200, 3,309,199, 4,013,633, 4,245,028 4,156,609, 4,139,383, 4,195,992, 4,148,641, 4,148,643 and 4,336,322; Japanese Patent Application (OPI) Nos. 114930/76 and 71072/81; and *Research Disclosure,* No. 17630(1978), and No. 16475 (1977).

Examples of magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; Japanese Patent Application (OPI) Nos. 106727/77, 36804/80, 23628/78, 73057/81, 71060/81 and 134/80.

Examples of cyan dyes include those described in U.S. Pat. Nos. 3,482,972, 3,929,760, 4,013,635, 4,268,625, 4,171,220, 4,242,435, 4,142,891, 4,195,994, 4,147,544 and 4,148,642; British Pat. No. 1,551,138; Japanese Patent Application (OPI) Nos. 99431/79, 8827/77, 47823/78, 143323/78, 99431/79, 71061/81; European Pat. No. 53,037 and 53,040; and *Research Disclosure* No. 17630 (1978) and No. 16475 (1977).

In addition, DRR compounds having a dye part which is a dye precursor having a light-absorption that is temporarily shifted may be used in the present invention, including those described in Japanese Patent Application (OPI) Nos. 5330/80 and 53329/80, U.S. Pat. Nos. 3,336,287, 3,579,334 and 3,982,946 and British Pat. No. 1,467,317.

The each amount of a yellow, magenta and cyan DRR compounds used is from about $1\times10^{-4}$ to $1\times1-10^{-2}$ mole/m$^2$, preferably from about $2\times10^{-4}$ to $2\times10^{-3}$ mole/m$^2$.

The DRR compound of the present invention may be incorporated in a photographic material in accordance with various known dispersion methods such as a solid dispersion method or an alkali dispersion method. In particular, a latex dispersion method is preferred, and an oil-in-water dispersion method is more preferred, which are representative means. In the oil-in-water dispersion method, the coupler is first dissolved in a single solution comprising either an organic solvent having a high boiling point of about 175° C. or higher or a solvent having a low boiling point (that is, a so-called auxiliary solvent) or in a mixture of a combination of both of these solvents; and then, the solution is finely dispersed in water or in an aqueous binder solution such as a gelatin solution in the presence of a surfactant. Examples of suitable organic solvents having a high boiling point are described in U.S. Pat. No. 2,332,027, etc. The dispersion may be accompanied by phase inversion. If necessary, the auxiliary solvent may be removed or amount reduced by distillation, noodle washing or ultrafiltration and thereafter the coupler containing dispersion may be coated on a photographic support.

Examples of suitable high boiling point organic solvents are phthalates (such as dibutyl phthalate, dicyclohexyl phthalate, di-2-ethylhexyl phthalate, didodecyl phthalate, etc.), phosphates and phosphonates (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, ci-2-ethylhexylphenyl phosphonate, etc.), benzoates (such as 2-ethylhexyl benzoate, dodecyl benzoate, 2-ethylhexyl p-hydroxy benzoate, etc.), amides (such as diethyldodecanamide, N-tetradecylpyrrolidone, etc.), alcohols and phenols (such as isostearyl alcohol, 2,4-di-tert-amylphenol, etc.), aliphatic carboxylates (such as dioctyl azelate, glycerol tributylate, isostearyl lactate, trioctyl citrate, etc.), aniline derivatives (such as N,N-dibutyl-2-butoxy-5-tert-octylaniline, etc.), hydrocarbons (such as paraffin, dodecylbenzene, diisopropylnaphthalene, etc.), etc. Organic solvents having a boiling point of about 30° to 160° C. or so can be used as the auxiliary solvent, and representative examples thereof are ethyl acetate, butyl acetate, ethyl propionate, methyl ethyl ketone, cyclohexanone, 2-ethoxyethyl acetate, dimethylformamide, etc.

For reproduction of natural color by the subtractive process, a light-sensitive element is used having at least light-sensitive emulsions, each having a different selective spectral sensitivity and a DRR compound having a selective spectral absorption in the same wavelength range.

In particular, light-sensitive elements containing a blue-sensitive silver halide emulsion in combination with a yellow DRR compound, a green-sensitive emulsion in combination with a magenta DRR compound and a red-sensitive emulsion in combination with a cyan DRR compound are useful. In these elements each spectrally-sensitized emulsion and corresponding DRR compound pair may be laminated and coated in a separate layer of the light-sensitive element, in sequence, or alternatively, each spectrally-sensitized silver halide and DRR compound may be combined in grains that are mixed and coated in one layer.

In the photographic materials of the present invention, a neutralizing layer is preferably provided in the image receiving element (between the support and the image receiving layer of the element), or in the light-sensitive element (between the support and the silver halide emulsion layer of the element). A neutralization-timing layer can optionally be used in combination with the neutralizing layer, (although the neutralization timing layer is not essential.)

The neutralizing layer preferably contains a film-forming acidic polymer and any conventional acidic polymer capable of forming a film may be used.

Examples of such acidic polymers include monobutylesters of maleic anhydride/ethylene copolymers; monobutylesters of maleic anhydride/methylvinylether copolymers; monoethylesters, monopropylesters, monopentylesters and monohexylesters of maleic anhydride/ethylene copolymers; monoethylesters, monopropylesters, monobenzylesters and monohexylesters of maleic anhydride/methylvinylether copolymers; polyacrylic acids; polymethacrylic acids; copolymers of acrylic acid and methacrylic acid in a various ratios; copolymers of acrylic acid or methacrylic acid with an other vinyl-type monomer such as an acrylate, methacrylate, vinylether, acrylamide or methacrylamide, in a various ratios, and preferably copolymers containing an acrylic acid or methacrylic acid content of about 50–90 mole%. Suitable neutralizing layer compositions are described in U.S. Pat. Nos. 3,362,819, 3,765,885 and 3,819,371 and French Pat. No. 2,290,699. In particular, polyacrylic acids and acrylic acid/butyl acrylate copolymers are preferably used as the neutralizing layer.

In the present invention, a hydrophilic polymer is used in combination with the above acidic polymers. A useful hydrophilic polymer which may be used in combination with the above acidic polymers includes, for example, polyacrylamide, polymethylpyrrolidone, polyvinyl alcohol (optionally partially saponified), carboxymethyl cellulose, hydroxymethyl cellulose, hydroxypropyl cellulose and polymethylvinylether. These polymers are commercially available, and any suitable polymer may be freely selected therefrom when used in the present invention. In particular, polyvinyl alcohol and polymethyl pyrrolidone are preferred, and polyvinyl alcohol is especially preferred among them.

The amount of acidic polymer in the neutralizing layer of the present invention may freely be determined in view of the ratio of the acid component in the polymer, to the alkaline concentration in the treating solution, or the preferred pH range for stabilization of the formed image; and is suitably within the range of about 1 g/m$^2$ to about 50 g/m$^2$, preferably from about 2–20 g/m$^2$. The amount of the hydrophilic polymer blended with the acidic polymer varies, depending upon the characteristics of the polymer (the necessary amount capable of having a film strength or the molecular weight thereof) or upon the desired improvement degree, and is in general, suitably about 1 to 30 g/m$^2$, preferably about 2 to 10 g/m$^2$. If the amounts of both the acidic polymer and the hydrophilic polymer are outside these ranges, the photographic quality will be decreased. In addition, the ratio of the acidic polymer to the hydrophilic polymer present is suitably within the range of about 10/1 —about 1/10, preferably about 3/1–1/3.

Additives may be incorporated in the neutralizing layer of the photographic material of the present invention for various purposes. For example, a conventional hardening agent, which is well known to those skilled in the art, may be added to harden the neutralizing layer, and the amount of the agent added may appropriately be determined in accordance with the desired degree of hardness of the layer. A polyhydric hydroxyl compound such as polyethylene glycol, polypropylene glycol or glycerin may be added for the purpose of softening the neutralizing layer. In addition, other additives such as an antioxidant, a fluorescent whitening agent, a dye for blue-coloration and/or a wetting-agent may also be added to the neutralizing layer if desired.

The neutralization-timing layer which is optionally used in combination with the neutralizing layer contains as an essential component, for example, a gelatin, a polyvinyl alcohol, a polyacrylamide, a partially hydrolyzed polyvinyl acetate, a copolymer of $\beta$-hydroxyethyl methacrylate and ethyl acrylate or an acetyl cellulose. In addition, those described in U.S. Pat. Nos., 3,455,686, 3,421,893, 3,785,815, 3,847,615, 4,009,030 and Japanese Patent Application (OPI) No. 14415/77 may also be used as the essential component of said neutralization-timing layer. Furthermore, another polymer layer may additionally be used together with the neutralization-timing layer, the additional layer having a permeability to the alkaline treating solution that is largely temperature-dependent, such as those described in U.S. Pat. Nos. 4,056,394 and 4,061,496 and Japanese Patent Application (OPI) Nos. 72622/78 and 78130/79.

In addition, the neutralization-timing layer can contain a polymer product obtained from a monomer which is $\beta$-releasable under alkaline conditions and examples of such polymer products are described in U.S. Pat. Nos. 4,297,431, 4,288,523, 4,201,587, 4,229,516; Japanese Patent Application (OPI) Nos. 121438/80, 166212/81, 41490/80, 54341/80, 102852/81, 141644/82, 173834/82, 179841/82, 19137/85; West German Patent Application (OLS) No. 2,910,271; European Pat. No. EP 31957A1; and *Research Disclosure,* No. 18452 (August, 1979).

For the image receiving layer used in the present invention, a hydrophilic colloid layer containing a polymer mordant is preferred.

Polymer mordants which may be used in the present invention are polymers containing secondary and/or tertiary amino groups, polymers containing nitrogen-containing heterocyclic moieties and quaternary cation-containing polymers thereof, having a molecular weight of about 5,000 to 200,000, preferably about 10,000 to 50,000.

Examples of such polymer mordants include vinylpyridine polymers and vinyl-pyridinium polymers described in U.S. Pat. Nos. 2,548,564, 2,484,430, 3,148,061 and 3,756,814; imidazole-type polymers as described in Japanese Patent Application (OPI) Nos. 48210/80 and 129346/80, U.S. Pat. Nos. 4,282,305, 4,273,853, 4,193,796, 4,228,257 and 4,229,515; polymer mordants capable of being cross-linked with gelatin, as described in U.S. Pat. Nos. 3,625,694, 3,859,096, 4,128,538, and British Pat. No. 1,277,453; latextype mordants and aqueous sol-type mordants described in U.S. Pat. Nos. 3,958,995, 2,721,852 and 2,798,063, and Japanese Patent Application (OPI) Nos. 115228/79, 145529/79 and 126027/79 and Japanese Patent Application (OPI) No. 232340/84; water-insoluble mordants described in U.S. Pat. No. 3,898,088; reactive mordants capable of being bound with a dye by a covalent bond, described in U.S. Pat. No. 4,168,976 (corresponding to Japanese Patent Application (OPI) No. 137333/79); and mordants described in U.S. Pat. Nos. 3,709,690, 3,788,855, 3,642,482, 3,488,706, 3,557,066, 3,271,147, 3,271,148, and Japanese Patent Application (OPI) Nos. 71332/75, 30328/78, 155528/77, 125/78 and 1024/78.

In addition, mordants described in U.S. Pat. Nos. 2,675,316 and 2,882,156 may be used in the present invention.

Mordants which are hard to move from the mordant layer to the other layers of the photographic material are preferred, and in particular, mordants capable of being cross-linked with a matrix such as gelatin, water-insoluble mordants and latex-dispersion (or aqueous sol)-type mordants are especially preferred.

Any conventional silver halide developer may be used in the present invention that is capable of reacting with a dye providing substance by cross-oxidation. The developer may be incorporated in an alkaline treating solution, or alternatively, may be incorporated in layers not having a silver halide emulsion in the light-sensitive element. The amount of the developer used is preferably from about $2\times10^{-3}$ mol/m$^2$ to $2\times10^{-2}$ mol/m$^2$, and is more preferably from about $4\times10^{-3}$ mol/m$^2$ to $9\times10^{-3}$ mol/m$^2$. Examples of developers which may be used in the present invention include hydroquinones, aminophenols, phenylenediamines and pyrazolidinones (such as 1-phenyl-3-pyrazolidinone, dimmeson, 1-p-tolyl-4,4-dihydroxymethyl-3-pyrazolidinone, 1-p-tolyl-4-methyl-4-hydroxymethyl-3-pyrazolidinone, 1-(4'-methoxyphenyl)-4-methyl-4-hydroxymethyl-3-pyrazolidinone, 1-phenyl-4-methyl-4-hydroxymethyl-3-pyrazolidinone), described in U.S. Pat. No. 4,336,322.

Among such developers, monochromatic developers capable of reducing stain-formation in the image receiving layer (particularly preferably pyrazolidinones) as described in T. H. James, *The Theory of the Photographic Process,* 4th Edition, page 345 (1977), are more preferred than other color developers such as phenylenediamines.

The alkaline treating solution which may be used in the present invention includes a base such as sodium hydroxide, potassium hydroxide, sodium carbonate or sodium phosphate, having an alkaline strength of about pH 9 or more, preferably of about pH 11.5 or more. The treating solution may further contain an antioxidant such as sodium sulfite, ascorbic acid salts or piperidino-hexose-reductone, and in addition, may contain a silver ion-concentration regulatory agent such as potassium bromide. Moreover, the solution may contain a viscosity-increasing compound such as hydroxyethyl cellulose or sodium carboxymethyl cellulose.

In addition, said alkaline treating solution may contain a development accelerator or a color-diffusion accelerator compound (such as benzyl alcohol). Furthermore, the alkaline treating solution may contain a white pigment (such as $TiO_2$ or $ZnO_2$) for the purpose of forming a background (white reflection layer) for the transferred image, or may contain a black pigment (such as carbon black) or a compound which may become black under alkaline conditions and may change to colorless under neutral conditions to permit development to be carried out in light.

The treating element is preferably composed of a container containing the alkaline treating solution, which may be broken under pressure.

More precisely, in the photographic material of the present invention, the light-sensitive element is first exposed and then the light-sensitive element and the image receiving element are superposed in face-to-face contact with a container containing an alkaline treating solution therebetween passed through a pair of press-roll members adapted to repture the container, release the treating solution and spread the treating solution uniformly over the entire surface of the light-sensitive element and the image receiving element to develop the exposed silver halide, and thereafter to transfer the image-forming substance to the image receiving element. Development can take place outside the camera in this preferred embodiment of the photographic material of the present invention.

The photographic material of the present invention has an integrated structure including the light-sensitive element, the image receiving element and the alkaline treating element, and may be either a unitary type in which the formed image is viewed through the support of the image receiving element or preferably a peel-apart type in which the image receiving element is peeled-apart from the light-sensitive element after the treating solution has been spread.

The present invention will be explained in greater detail by reference to the following examples, which, however, are to be construed as limiting the scope thereof. Unless otherwise indicated, all parts, percents and ratios are by weight.

EXAMPLE 1

The following layers were formed on a polyethylene terephthalate support 0.08 μm thick, to obtain a light-sensitive element.

Backing layer side: (a) A light-shielding layer containing carbon black (4.0 g/m$^2$) and gelatin (2.0 g/m$^2$).

Light-sensitive layer side: The following layers (1) through (12) were coated in that order on the opposite surface of the support from the backing layer.

(1) A layer containing the following cyan DRR compound (0.42 g/m$^2$), tricyclohexyl phosphate (0.03 g/m$^2$) and gelatin (0.51 g/m$^2$).

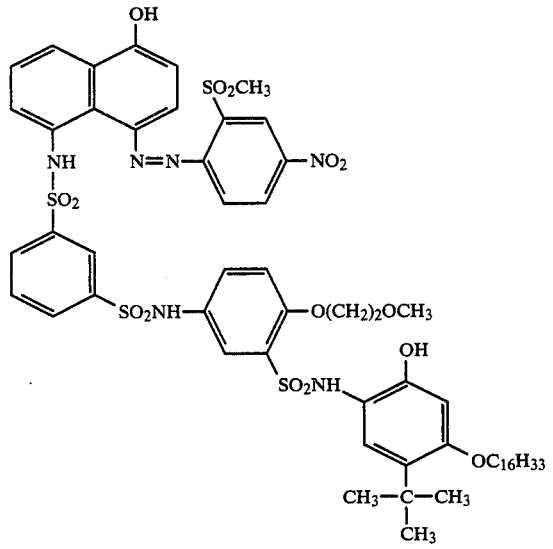

(2) Development accelerating layer containing the following compound (0.008 g/m$^2$) and gelatin (0.46 g/m$^2$).

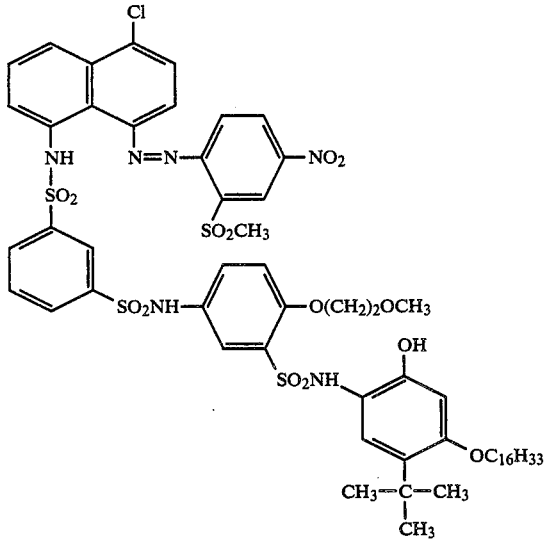

(3) A red-sensitive silver halide emulsion layer containing red-sensitive internal latent image-type direct reversal silver bromide emulsion (0.38 g/m$^2$, calculated as sliver), gelatin (0.76 g/m$^2$), the following nucleating agent (5 μg/m$^2$) and sodium pentadecylhydroquinonesulfonate (0.02 g/m$^2$).

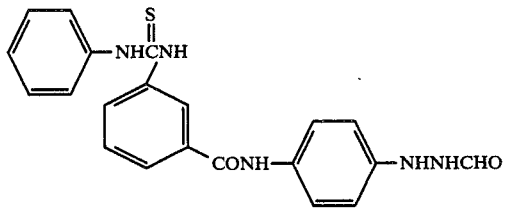

(4) An interlayer containing the following compound (0.68 g/m$^2$), polymethyl methacrylate (molecular weight about 50,000) (0.34 g/m$^2$) and gelatin (0.3 g/m$^2$). The mixture of 60 to 90% of

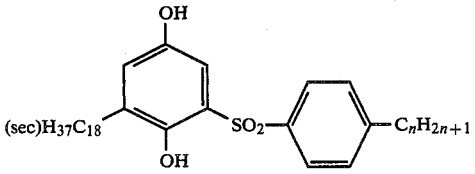

(n = 9 to 13, average 12)

and 40 to 10% of

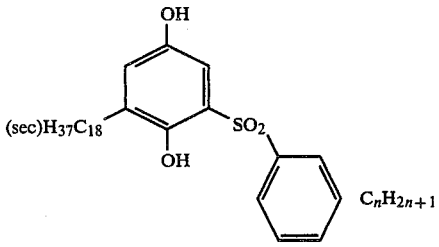

(n = 9 to 13, average 12)

(5) A layer containing gelatin (0.23 g/m$^2$).

(6) A layer containing the following magenta DRR compound (0.54 g/m$^2$) and gelatin (0.69 g/m$^2$).

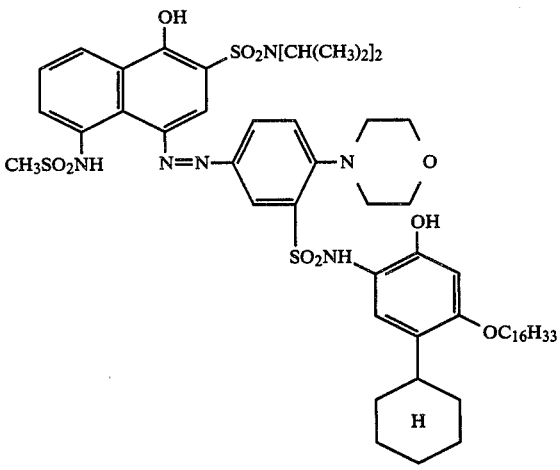

(7) A green-sensitive silver halide emulsion layer containing green-sensitive internal latent image-type direct reversal silver bromide emulsion (0.46 g/m$^2$, calculated as silver), gelatin (0.94 g/m$^2$), the same nucleating agent as layer (3) (6.5 g/m$^2$) and sodium pentadecylhydroquinone-sulfonate (0.07 g/m$^2$).

(8) An interlayer containing 2,5-di(tert-pentadecy) hydroquinone (0.82 g/m$^2$), polyvinyl acetate, (molecular weight about 50,000) (0.8 g/m$^2$) and gelatin (0.4 g/m$^2$).

(9) A layer containing gelatin (0.25 g/m$^2$).

(10) A layer containing the following yellow DRR compound (0.52 g/m$^2$), tricyclohexyl phosphate (0.03 g/m$^2$) and gelatin 0.58/m$^2$).

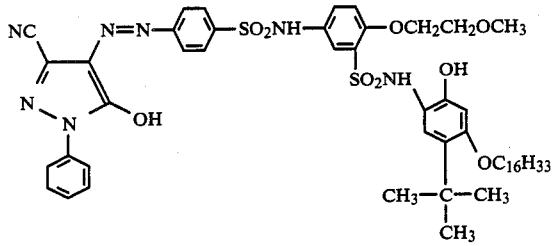

(11) A blue-sensitive silver halide emulsion layer containing blue-sensitive internal latent image-type direct reversal silver bromide emulsion (0.74 g/m$^2$, calculated as silver), gelatin (0.98 g/m$^2$), the same nucleating agent as layer (3) (12.4 μg/m$^2$) and sodium pentadecylhydroquinone-sulfonate (0.05 g/m$^2$).

(12) A protective layer containing gelatin (1.0 g/m$^2$).

The following hardening agent of 14 mg/m$^2$, 34 mg/m$^2$ and 54 mg/m$^2$ was further added to layer (12), to form samples A, B and C respectively, each having a different swelling degree.

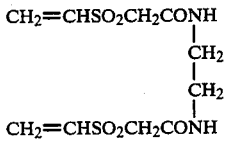

The following layers were coated on a paper support to obtain an image receiving element.

Paper support: A paper having a thickness of 150μ was sandwiched with two polyethylenelaminate coats each having a thickness of 30μ. In the polyethylene-coat laminated on one surface of the paper was incorporated a dispersion of titanium oxide (average grain diameter 0.3 μm) in an amount of 10% by weight on the basis of the polyethylene.

Backing layer side: The following layers (a') through (c') were coated in order on the polyethylene coat without titanium dioxide.

(a') A light-shielding layer containing carbon black (average grain diameter 0.08 μm) (4.0 g/m$^2$) and gelatin (2.0 g/m$^2$).

(b') A white reflecting layer containing titanium oxide, (average grain diameter 0.3 μm) (8.0 g/m$^2$) and gelatin (1.0 g/m$^2$).

(c') A protective layer containing gelatin (0.6 g/m$^2$).

Image receiving layer side: The following layers (1') through (5') were coated in order on the polyethylene layer containing titanium dioxide.

(1') A neutralizing layer containing polyvinyl alcohol having a viscosity of 4.7 to 5.4 centipoise at 20° C. of the 4% aqueous solution (molecular weight about 100,000) (5 g/m$^2$) and butyl acrylate/acrylic acid copolymer (molar ratio=30/70) (5 g/m$^2$).

(2') A neutralization-timing layer containing cellulose acetate (molecular weight about 50,000) having an acetylation degree of 51.3% (which means that the weight of the acetic acid released by hydrolysis is 0.513 g per 1 g of a sample) and styrene/maleic anhydride copolymer (molar ratio=1:1) having an average molecular weight of about 10,000, in an amount of 4.5 g/m$^2$, in which the weight ratio of cellulose acetate to the copolymer was 95:5.

(3') A layer containing a polymer latex (average grain diameter 0.06 μm) obtained by emulsion polymerization of styrene/butyl acrylate/acrylic acid/N-methylolacrylamide in a weight ratio of 49.7/42.3/4/4, and a polymer latex (average grain diameter 0.06 μm) obtained by emulsion polymerization of methyl methacrylate/acrylic acid/N-methylol-acrylamide in a weight ratio of 93/3/4, polymer latexes being blended in a solid weight ratio of 6/4, and the total solid content of the layer containing the two polymers being 1.6 g/m$^2$.

(4') An image receiving layer formed by coating the following polymer (3.0 g/m$^2$) and gelatin (3.0 g/$^2$) in the presence of a coating aid of the following formula:

Coating aid:

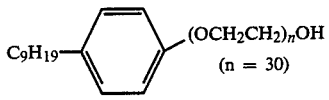

Polymer:

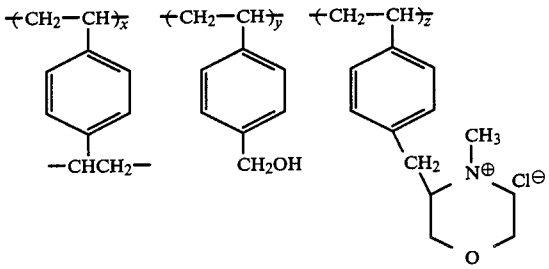

X:Y:Z = 5:5:90

(5') A layer containing gelatin (0.6 g/m$^2$).

400 mg/m$^2$ of the first hardening agent (Compound (I)), 76 mg/m$^2$ of the second hardening agent (Compound (II)) and 6 mg/m$^2$ of the third hardening agent (Compound (III)) were added to layer (1'), (3') and (4'), respectively, to prepare sample D.

Sample E was prepared in the same manner as described for sample D except that 14 mg/m$^2$ of the third hardening agent (Compound (III)) was added to layer (4').

Sample F was prepared in the same manner as described for sample D except that 30 mg/m$^2$ of the third hardening agent (Compound (III)) was added to layer (4').

Each sample has a different swelling degree.

Compound (I)

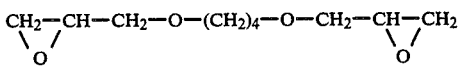

Compound (II)

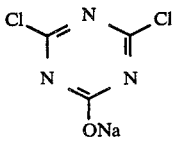

HCHO

Compound (III)

A treating solution containing the following components was filled in a rupturable container in an amount of 0.9 g, to form a treating element.

Treating solution composition:

1-m-Tolyl-4-hydroxymethyl-4-methyl-3-pyrazolidone: 10.0 g

1-Phenyl-4-hydroxymethyl-4-methyl-3-pyrazolidone: 4.0 g

5-Methylbenzotriazole: 7.0 g

Potassium sulfite: 8.0 g

Hydroxyethyl cellulose having a viscosity of 4,800 to 6,000 centipoise at 25° C. of the 2% aqueous solution: 47 g Potassium hydroxide: 56 g Benzyl alcohol: 3.4 ml Titanium oxide (average grain diameter 0.3 μm): 1.3 g Water to make: 1 kg (total weight)

Each light-sensitive element was exposed through an optical wedge at exposure of 4,800 K light source, 1,000 lux and 1/100 sec (10CMS). (For the measurement of sharpness, each light-sensitive element was exposed through a particular wedge having different space frequency (line/mm) at 100 lux, and then this was superposed with the image receiving element, in face-to-face relationship, with the alkaline treating element therebetween. This laminated material was pressed with a press-roll number whereby the treating solution was uniformly spread between the light-sensitive element and the image receiving element in a layer thickness of 60 μm. The layer thickness (d) is defined by the following formula:

$$(d) = \frac{(A) - (B)}{(\rho) \times (S)}$$

wherein (A) is a weight of a unit area (S) after the spread of the treating solution, (B) is a weight of a unit area (S) before the spread of the treating solution, ($\rho$) is a density of the treating solution and (S) is a unit area.

The treatment was carried out at 25° C., and after 90 seconds the light-sensitive element was peeled apart from the image receiving element off, to obtain a transferred image on the image receiving element. The quality of the image obtained was evaluated, with the results given in the following Table 1. The test results given in Table 1 indicate the following:

(1) Density mottle:
Almost unnoticeable: 1
Slight occurrence: 2
Noticeable occurrence: 3

(2) White spots:
Almost unnoticeable: 1
Slight occurrence: 2
Noticeable occurrence: 3

(3) Sharpness: This is designated by means of space frequency (line/mm) at 50% of C.T.F. (Cycle Transfer Function, response coefficient) as described in G.C. Brock, *Image Evaluation for Aerial Photograph*, pages 62–88, The Focal Press, London (1970), with respect to only magenta color having the highest visual sensitivity (measured with a G-filter).

(4) Cyan-Density Dmax: Cyan-density varies widely, depending upon the variation of the swollen film thickness of each of the light-sensitive element and the image receiving element and upon the variation of the layer thickness of the treating solution. Accordingly, Dmax of the cyan-density only is shown in Table 1.

The results contained in Table 1 demonstrate that the combinations of samples A-F having at least one swollen film thickness greater than that according to the invention (i.e., light-sensitive material sample Nos. 1, 2, 3, 4 and 7) were unacceptable in view of the occurrence of density mottle and white spots due to air-bubbles, since the quality of the formed image largely depends upon the occurrence of density mottle and white spots, which seriously degrade the image quality. On the other hand, the other combinations of elements in photographic material samples 5, 6, 8 and 9 were good. The most preferred combinations in photographic material samples 5 and 8 resulted in excellent sharpness.

TABLE 1

| Light-sensitive material | Light-sensitive element | Swollen film thickness of light-sensitive element (μm) | Image receiving element | Swollen film thickness of image receiving element (μm) | Thickness of layer of treating solution (μm) | Density mottle | White spots | Sharpness | Cyan-density (Dmax) |
|---|---|---|---|---|---|---|---|---|---|
| Sample No. | | | | | | | | | |
| 1 | Sample A | 57 | Sample D | 45 | 60 | 3 | 2 | 4.0 | 2.12 |
| 2 | " | 57 | Sample E | 20 | 60 | 2 | 1 | 3.3 | 2.25 |
| 3 | " | 57 | Sample F | 12 | 60 | 2 | 1 | 2.6 | 2.61 |
| 4 | Sample B | 28 | Sample D | 45 | 60 | 2 | 2 | 4.1 | 2.30 |
| 5 | " | 28 | Sample E | 20 | 60 | 1 | 1 | 3.5 | 2.51 |
| 6 | " | 28 | Sample F | 12 | 60 | 1 | 1 | 3.0 | 2.74 |
| 7 | Sample C | 19 | Sample D | 45 | 60 | 2 | 2 | 4.5 | 2.63 |
| 8 | " | 19 | Sample E | 20 | 60 | 1 | 1 | 3.8 | 2.75 |
| 9 | " | 19 | Sample F | 12 | 60 | 1 | 1 | 3.3 | 2.89 |

EXAMPLE 2

The same combination of light-sensitive element B and image receiving element E as in light-sensitive material sample No. 5 of Table 1 was exposed and processed in the same manner as in Example 1, with the exception that the thickness of the treating solution layer was 35 μm, 60 μm and 85 μm. The treatment was carried out at 25° C. After 90 seconds, the image receiving element was peeled apart from the light-sensitive element, to obtain a transferred image thereon. The results given in the following Table 2 demonstrate that where the treating solution layer had a thickness of 60 μm the best results were obtained.

TABLE 2

| Light-sensitive material | Light sensitive element | Swollen film thickness of light-sensitive element (μm) | Image receiving element | swollen film thickness of image receiving element (μm) | Thickness of layer of treating solution (μm) | Density mottle | White spots | sharpness | Cyan-density (Dmax) |
|---|---|---|---|---|---|---|---|---|---|
| Sample No. | | | | | | | | | |
| 5′ | Sample B | 28 | Sample E | 20 | 35 | 3 | 3 | 4.9 | 2.05 |
| 5″ | " | 28 | " | 20 | 60 | 1 | 1 | 3.5 | 2.53 |
| 5‴ | " | 28 | " | 20 | 85 | 1 | 1 | 2.0 | 2.55 |

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material comprising (A) a light-sensitive element comprising a first support having thereon at least a silver halide photographic emulsion layer, a color forming compound and a hardening agent for controlling the swollen film thickness thereof, (B) an image receiving element comprising a second support having thereon at least an image receiving layer and a hardening agent for controlling the swollen film thickness thereof and (C) means for providing an alkaline treating solution between element (A) and (B), wherein:

(i) the swollen film thickness of said light-sensitive element (A) is from about 10 μm to 45 μm after being contacted with water at 25° C. for 5 minutes;

(ii) the swollen film thickness of said image receiving element (B) is from about 10 μm to 45 μm after being contacted with a 0.1N KOH aqueous solution at 25° C. for 3 minutes; and (iii) said means for providing an alkaline treating solution provides an average thickness of said treatment of from about 40 μm to 80 μm.

2. The color diffusion transfer photographic material as claimed in claim 1, wherein the hardening agent is selected from the group consisting of a chromium salt, an aldehyde, an N-methylol compound, a diketone, a mucohalogenic acid, an active halogeno-compound, an active vinyl compound, a dioxane derivative, an epoxy compound, a phenol and a carbodiimide compound.

3. The color diffusion transfer photographic material as claimed in claim 1, wherein the hardening agent is contained in each of said elements in an amount of from about 0.03 mmol/m$^2$ to 3 mmol/m$^2$.

4. The color diffusion transfer photographic material as claimed in claim 1, wherein the swollen film thickness of the light-sensitive element (A) is from about 15–35 μm, the swollen film thickness of the image receiving element (B) is from about 15–30 μm and the thickness of the treating solution layer (C) is from about 50–70 μm.

5. The color diffusion transfer photographic material as claimed in claim 1, wherein the siliver halide photographic emulsion layer contained in the light-sensitive element (A) is an internal latent image silver halide emulsion.

6. The color diffusion transfer photographic material as claimed in claim 5, wherein the internal latent image silver hade emulsion is a core/shell emulsion obtained by coating a silver halide shell on a core grain.

7. The color diffusion transfer photographic material as claimed in claim 1, further comprising at least one of a means for neutralizing said alkaline treating solution in the image receiving element (B) between the support and the image receiving layer of said element and a means for neutralizing said alkaline treating solution in the light-sensitive element (A) between the support and the silver halide emulsion layer of said element.

8. The color diffusion transfer photographic material as claimed in claim 7, wherein the means for neutralizing comprises a neutralizing layer or a neutralization layer in combination with a neutralization-timing layer.

9. The color diffusion transfer photographic material as claimed in claim 8, wherein said neutralizing layer comprises a film-forming acidic polymer.

10. The color diffusion transfer photographic material as claimed in claim 1, wherein the image receiving layer of the image receiving element (B) comprises a hydrophilic colloidal layer containing a polymer mordant.

11. The color diffusion transfer photographic material as claimed in claim 10, wherein said polymer mordant has a molecular weight of from about 5,000 to 200,000 and is selected from the group consisting of secondary amino-containing polymers, tertiary amino-containing polymers, secondary and tertiary amino containing polymers, nitrogen-containing heterocylic polymers and quaternary cation-containing polymers thereof.

12. The color diffusion transfer photographic material as claimed in claim 1, wherein the alkaline treating solution has a pH of at least about 9 and contains a basic compound selected from the group consisting of sodium hydroxide, potassium hydroxide, sodium carbonate and sodium phosphate.

13. The color diffusion transfer photographic material as claimed in claim 2, wherein the hardening agent is contained in each of said elements in an amount of form about 0.03 mmol/m$^2$ to 3 mmol/m$^2$.

14. The color diffusion transfer photographic material as claimed in claim 7, wherein said neutralizing layer comprises a film-forming acidic polymer.

15. The color diffusion transfer photographic material is claimed in claim 11, wherein said polymer mordant has a molecular weight of from about 10,000 to 50,000 and is selected from the group consisting of secondary amino-containing polymers, tertiary amino-containing polymers, secondary and tertiary amino containing polymers, nitrogen-containing heterocyclic polymers and quaternary cation-containing polymers thereof.

16. The color diffusion transfer photographic material as claimed in claim 12, wherein the alkaline treating solution has a pH of at least about 11.5 and contains a basic compound selected from the group consisting of sodium hydroxide, potassium hydroxide, sodium carbonate and sodium phosphate.

* * * * *